US006215405B1

(12) United States Patent
Handley et al.

(10) Patent No.: US 6,215,405 B1
(45) **Date of Patent: *Apr. 10, 2001**

(54) PROGRAMMABLE TEMPERATURE SENSOR FOR SECURITY SYSTEM

(75) Inventors: Lucas Handley, Zephyr; James Parker, North York, both of (CA)

(73) Assignee: Digital Security Controls Ltd., Concord ( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/075,177

(22) Filed: May 11, 1998

(51) Int. Cl.[7] ..... G08B 17/00
(52) U.S. Cl. ..... 340/584; 340/521; 340/531
(58) Field of Search ..... 340/584, 585, 340/588, 589, 506, 521, 531, 533; 374/101, 110, 116, 141, 149; 99/344; 165/11.1, 11.2; 236/DIG. 8; 379/37

(56) References Cited

U.S. PATENT DOCUMENTS 4,482,785 * 11/1984 Finnegan et al. ..... 340/585 X
4,784,212 * 11/1988 Brimer et al. ..... 165/11.1 X
4,914,422 * 4/1990 Rosenfield et al. ..... 340/586 X
5,550,460 * 8/1996 Bellin et al. ..... 323/255
5,587,700 * 12/1996 Williams ..... 340/541

* cited by examiner

*Primary Examiner*—Thomas Mullen

(57) ABSTRACT

The present invention in one aspect, provides for a programmable temperature sensor for a device as part of a security or alarm system. The programmable temperature sensor is capable of having multiple set points programmed, each set point individually programmable as to effect. In a preferred embodiment of the invention, there is provided a keypad controller having a programmable temperature sensor for use in an alarm system. The keypad controller includes an input for allowing a user to interface with the keypad controller and an alarm system to which the keypad controller is connected, an output display for providing one or more of visual and auditory feedback to a user on the status of the system, an interface for communicating with an alarm control panel of an alarm system, a processor for processing inputs from the input or an alarm control panel and causing the appropriate information to be provided to the output display, and a programmable temperature sensor for monitoring the temperature in the space in which the keypad controller is to be located, the temperature sensor being provided with at least one alarm set point programmable as to level.

6 Claims, 5 Drawing Sheets

PROGRAMMABLE TEMPERATURE SENSOR FOR SECURITY SYSTEM

FIELD OF THE INVENTION

The present invention relates to a programmable temperature sensor for a device as part of a security system and the device having such programmable temperature sensor. In a preferred embodiment, the programmable temperature sensor is capable of having multiple set points, each individually programmable as to effect.

BACKGROUND OF THE INVENTION

Temperature sensors are utilized in a wide variety of applications in which it is necessary to monitor the temperature within a space. For example, cold rooms are used for storage of perishable goods in which the goods much be kept within a specified temperature range to prevent spoiling of the goods. Temperature sensors are commonly utilized in such areas to monitor the temperature within the area to ensure that the temperature does not increase to a point where the goods may be at a risk of spoilage. In such applications, a separate temperature sensor is connected to an alarm system to provide for a warning if the temperature increases beyond a particular limit. This limit is generally set at the factory when the unit is manufactured and provides for a temperature sensor set point for the temperature sensor. If the temperature detected by the temperature sensor exceeds the temperature set point established during the manufacture of the unit, then the alarm system indicates the alarm. In applications where it is necessary to monitor more than one set point, such as an upper and a lower limit, a second separate temperature sensor is commonly utilized with its own individual set point distinct from the set point of the first sensor. These sensor set points are generally established during the manufacture of the unit and are not field programmable.

In addition to cold rooms, there are many other applications which utilize temperature sensors. For example, storage areas where products are stored which must be kept from freezing are required to have the temperature monitored to ensure that it does not fall below a level at which the products may freeze. Another example would be greenhouses utilized for production for commercial crops, particularly high value crops such as exotic plants and flowers as well as certain herbs. It is critical in such applications to maintain the temperature in the greenhouse within an acceptable growing range, while also ensuring that the temperature has not reached a level which would cause permanent damage to the crops, either by the temperature dropping below a level where the crops would be damaged, or increasing to a level where the crops would be damaged.

At the present time, in such circumstances, it is necessary when one wishes to monitor a variety of temperature set points, that separate temperature sensors are required for each of the set points to be monitored. In addition, once the temperature set points are established in the unit, it is extremely difficult for these temperature set points to be modified or changed, often requiring the unit to be returned to the factory for changing of the temperature set points.

Alarm systems which include a temperature sensor function require the temperature sensor to be an individual device, separate and apart from other devices of the alarm system. The provision of the temperature sensor as a separate device increases the cost of the alarm system installation both in terms of cost of the devices as well as in cost of the installation of the alarm system, as the temperature sensor requires its own wiring and interface to the alarm control panel. If the temperature sensor function could be provided as part of another alarm system device, the complexity and cost of the alarm system could be reduced.

There therefore remains a need for a means of providing a device for an alarm system with a temperature sensor function, where the set point of the temperature sensor is easily programmable. There also remains a need for an alarm system which would allow for monitoring of multiple temperature set points and in which the set points can be easily programmed depending upon the situation or location at which the alarm system is located.

SUMMARY OF THE INVENTION

The present invention provides in one aspect for a programmable temperature sensor for a device as part of a security or alarm system. The programmable temperature sensor is capable of having multiple set points programmed, each set point individually programmable as to level and effect.

In another aspect of the invention, there is provided a keypad controller for use in an alarm system. The keypad controller comprises an input means for allowing a user to interface with the keypad controller and an alarm system to which the keypad controller is connected, an output means for providing one or more of visual and auditory feedback to a user on the status of the system, an interface means for communicating with an alarm control panel of an alarm system, a processing means for processing inputs from the input means or an alarm control panel and causing the appropriate information to be provided to the output means, and a programmable temperature sensor for monitoring the temperature in the space in which the keypad controller is to be located, the temperature sensor being provided with at least one alarm set point programmable as to level.

BRIEF DESCRIPTION OF THE DRAWINGS

Preferred embodiments of the present invention are illustrated in the attached drawings, in which.

DETAILED DESCRIPTION OF THE PREFERRED EMBODIMENTS

Figure 1:
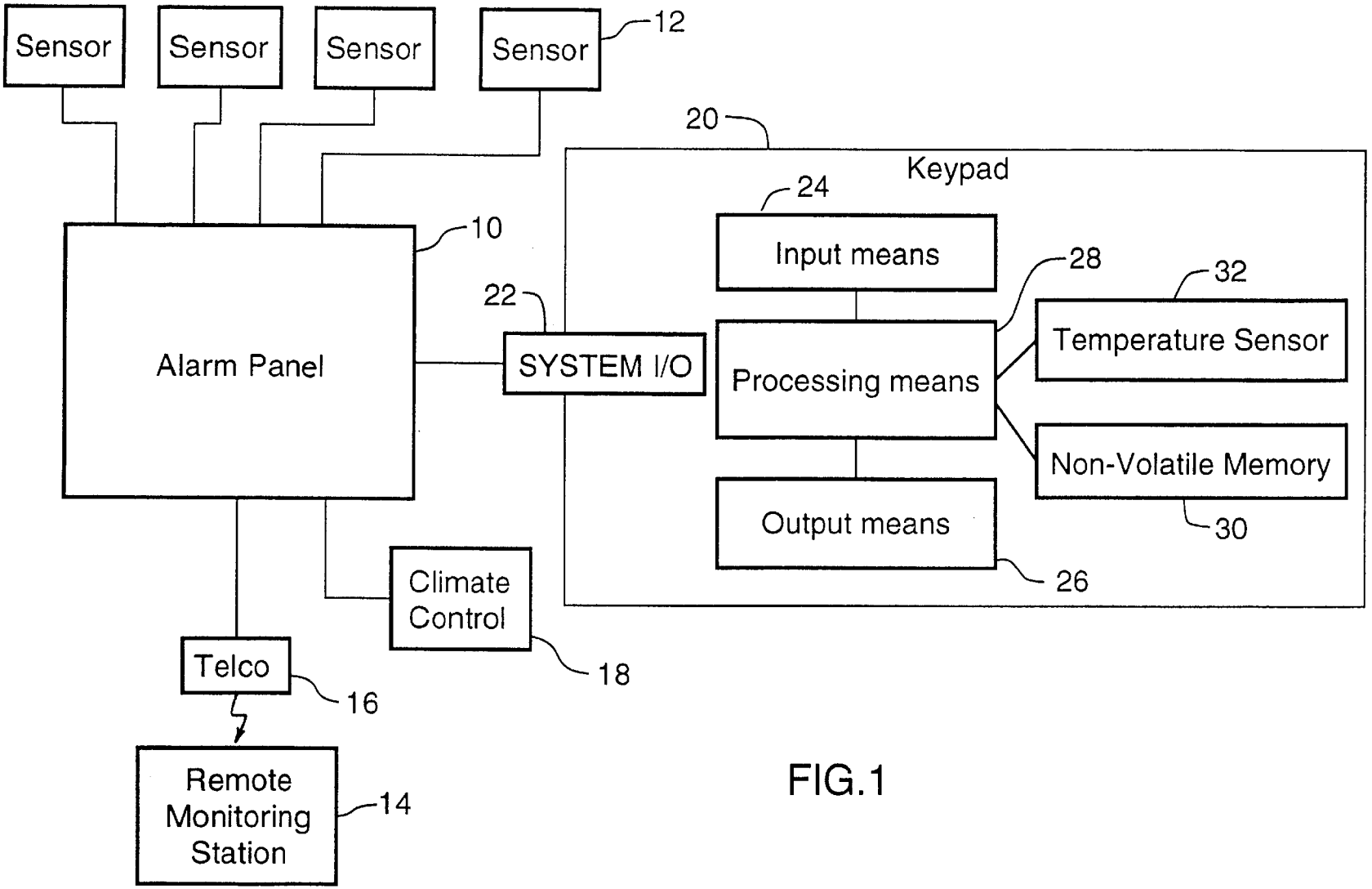
FIG. 1 is a block diagram of an alarm system of the present invention, incorporating a keypad with a programmable temperature sensor as part of the keypad.

FIG. 1 illustrates a block diagram of a security or alarm system incorporating a device having a programmable temperature sensor according to a preferred embodiment of the present invention. Alarm system comprises an alarm control panel 10 which controls the operation of the overall system. A number of detection devices or sensors 12, utilized for monitoring a zone or area of protection, are connected to the control panel in a typical manner. Sensors 12 may be any of the commonly utilized sensors such as motion detectors, door contacts, glass break detectors, shock sensors, fire detectors, water detectors, etc. The sensors 12 in FIG. 1 are shown hard wired to the control panel 10, however, wireless technology is in common use and any of the sensors 12 could use wireless communication between the detection devices 12 and the control panel 10. The alarm system may be capable of reporting to a remote monitoring station 14, utilizing any of the commonly employed methods of communication such as utilizing a telephone dialer sending messages to the remote monitoring station 14 using local telephone systems 16. In some situations, the connection between the control panel 10 and the remote monitoring location 14 may also be wireless, utilizing cellular telephone technology or other means of wireless communication. The system may also use other communication arrangements such as two way cable systems. A keypad controller 20 is also connected to the control panel 10 for allowing the user to interface with the alarm system, to program the system and control the operation of the system and for displaying the status of the system and its various components.

The keypad controller 20 of the alarm system illustrated in FIG. 1 is provided with a system input/output interface (SYSTEM I/O) 22 for interfacing with the alarm control panel 10. The SYSTEM I/O 22 may also be utilized to interface with other devices, such as auxiliary heating or cooling equipment, either directly utilizing the SYSTEM I/O 22, or through the alarm panel 10 which as illustrated in FIG. 1 interfaces with a climate control system 18. Keypad controller 20 is provided with an input means 24 to allow the user to interface with the alarm system. Input means 24 may be a simple numeric keypad, or an alphanumeric keypad, or may be provided through a graphical interface provided as part of a touch-screen of the keypad controller 20. Keypad controller 20 is also provided with an output means 26 for providing visual or auditory feedback to the user and for providing information on the status of the system and its various components. Output means 26 may provide either visual or auditory feedback or may provide for a combination of both types of feedback. For visual feedback, the output means 26 may include a simple one or two line LED or LCD display, or may be a larger LCD display capable of displaying graphical messages in addition to alphanumeric messages. If such a larger LCD display is provided, it may also function as an input means 24 through a touch-screen capability.

The input means 24 and output means 26 of the keypad controller 20 are connected to a processing means 28 which processes the inputs from the input means 24, passes data to and receives data from the alarm control panel 10 through the SYSTEM I/O 22 as provided, and provides for display for feed back to the user and the status of the system on the output means 26. Keypad controller 20 may also be provided with non-volatile memory 30 for storing instructions for the processing means 28 as well as for storing various parameters for the operation of the system. Keypad controller 20 is also provided with a temperature sensor 32 which, according to the present invention has at least one set point which is programmable as to level. Preferably, as will be described further herein below, the temperature sensor 32 is programmable to have multiple set points. Temperature sensor 32 is provided with a temperature sensing means which provides an output which varies in proportion to the temperature sensed. Temperature sensor is also provided with an interface or signal conditioning means to allow the processing means 28 to receive a signal indicative of the temperature, compare this signal against one or more set points and take the appropriate action. Temperature sensing means may utilize any of the currently available technologies or any technology developed in the future. For example, temperature sensing means may be a resistive sensor which varies in resistance with temperature. Examples of resistive sensors include a Resistance Temperature Detector utilizing platinum wire or film or a thermistor. The temperature sensing element may also be a thermocouple which varies in output voltage with temperature. The temperature sensing element may also be a temperature sensor IC whose output varies with temperature. The output of the IC may be voltage or current or may provide an internal comparator to output a digital signal. Examples of such temperature sensor ICs are those produced by National Semiconductor such as the LM35 and LM45 Celsius sensors which provide a voltage output, the LM134, LM234 and LM334 Current-Output Temperature Sensors, and the LM56 Low-Power thermostat providing a comparator output. For temperature sensing elements which provide a resistance, voltage or current output, signal conditioning to provide an appropriate signal to the processing means will be required. Such signal conditioning means may include an A/D converter to convert the output voltage or current into a digital word which can be used by the processing means to compare against the threshold value, or a comparator to compare the output against reference levels representing expected values at the threshold set points. The output from the signal conditioning means will be provided to the processing means and may also require an interface, depending upon the nature of the output.

Still another temperature sensor IC is the LM75 Digital Temperature Sensor which includes an onboard A/D converter which converts the output of the temperature sensing element to a digital word and stores the digital word in an addressable register. This is the preferred temperature sensor for use in the present invention as the temperature sensed has already been converted into a digital word and stored in an addressable register. Another advantage of the LM75 Temperature Sensor is that it utilizes an $I^2C$ bus so it is easy to interface with the processing means 28. The processing means 28 will query the LM75 Temperature sensor 32 by reading the value stored in the temperature register. This value will be compared to the value for the temperature set point to determine whether the temperature exceeds the set point temperature as will be described further below.

The control system setup, as illustrated in FIG. 1 is of particular use in installations where it is desirable or necessary to monitor the temperature in the space in which the keypad controller is located. Examples of such locations may include greenhouses, cold storage rooms, or other such installations.

Figure 2:
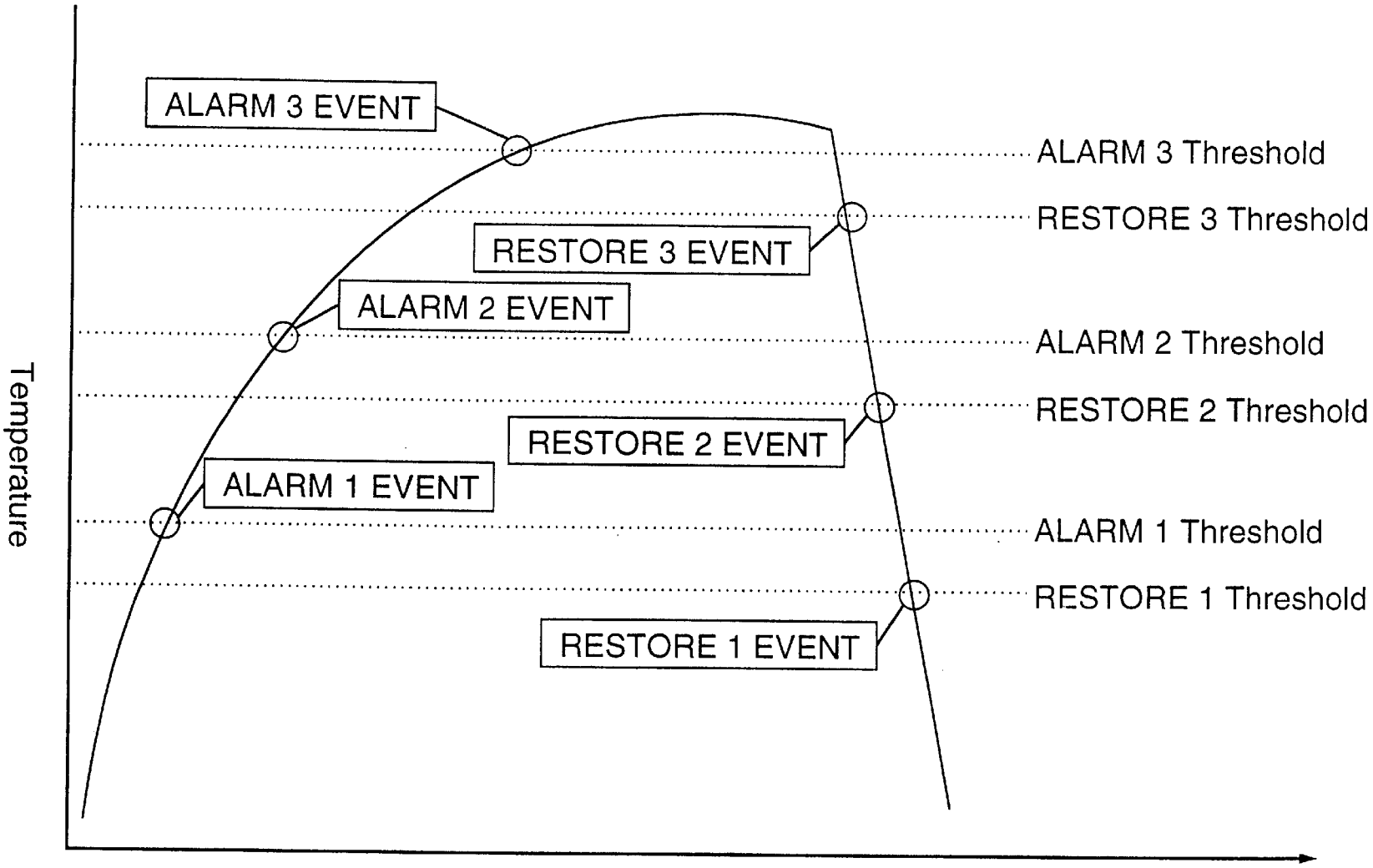
FIG. 2 is a graph illustrating the detection of a temperature increase and recovery at the programmable sensor of the keypad of FIG. 1 varying over time and the associated events that occur.

FIG. 2 illustrates the concept of multiple set points using a device such as the keypad controller 20 shown in FIG. 1 with a temperature sensor with three set points or thresholds to which the alarm system will respond. The alarm system of FIG. 2 has been programmed for use in a cold area so that the alarm condition being monitored is an increase in temperature. In prior art systems, a single set point would be provided and when the temperature exceeded the threshold, an alarm condition was signaled which may also have been transmitted to a remote monitoring station, depending upon the situation. In the embodiment of the invention illustrated in FIG. 2, ALARM 1 threshold may for example, signal a local trouble condition, ALARM 2 threshold may signal an alarm and initiate an alarm transmission to a remote monitoring station and ALARM 3 threshold may activate a back-up cooling system. As the temperature increases in the monitored area, the ALARM 1 threshold will be exceeded and the alarm system will annunciate a local trouble condition to alert the user to a potential climate control system failure. If corrective action is not taken, and the temperature continues to rise above the ALARM 2 threshold, the alarm system will report the over-temperature condition to a remote monitoring station, indicating that a service call is required. If the necessary repairs are not made before the temperature exceeds the ALARM 3 threshold, the security system using a pre configured I/O such as is shown in FIG. 1 will activate a back-up climate control system or take other actions to limit the severity of damage caused by the over-temperature condition.

When the temperature drops back below the ALARM 3 threshold, no action is taken. The temperature must drop below the RESTORE 3 threshold before the back-up system is deactivated or the other action associated with the ALARM 3 threshold is deactivated or reversed. This hystersis prevents multiple unwanted ALARM and RESTORE conditions from occurring if the temperature fluctuates about the threshold point. The system responds in a similar fashion as the temperature drops below the RESTORE 2 and RESTORE 1 thresholds, sending an over-temperature restore signal to the monitoring station and clearing the over-temperature trouble condition respectively.

Figure 3A:
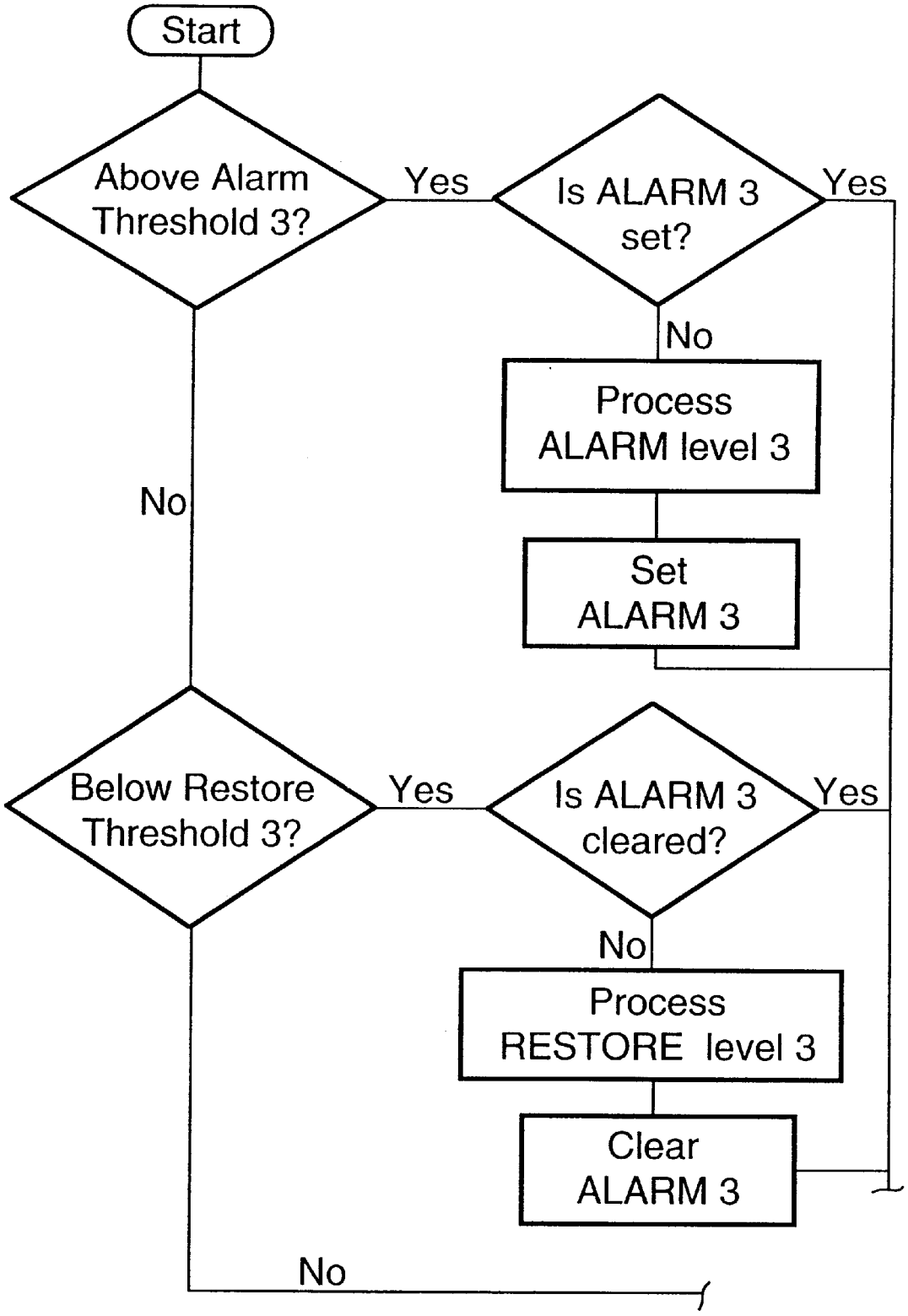
FIG. 3 is a flow chart showing the program flow for evaluating the temperature in a monitored area utilizing a device according to FIG. 1.
Figure 3B:
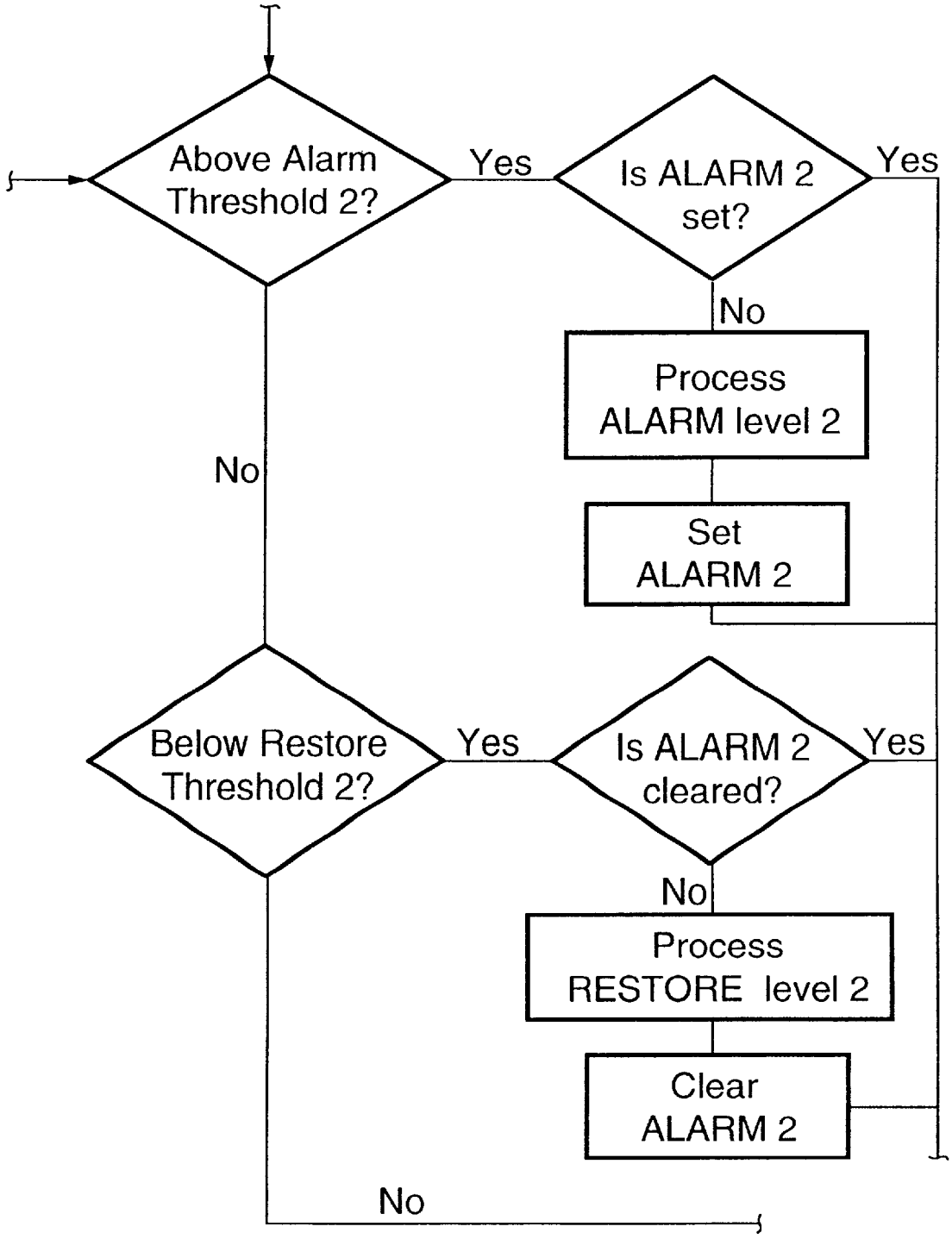
Figure 3C:
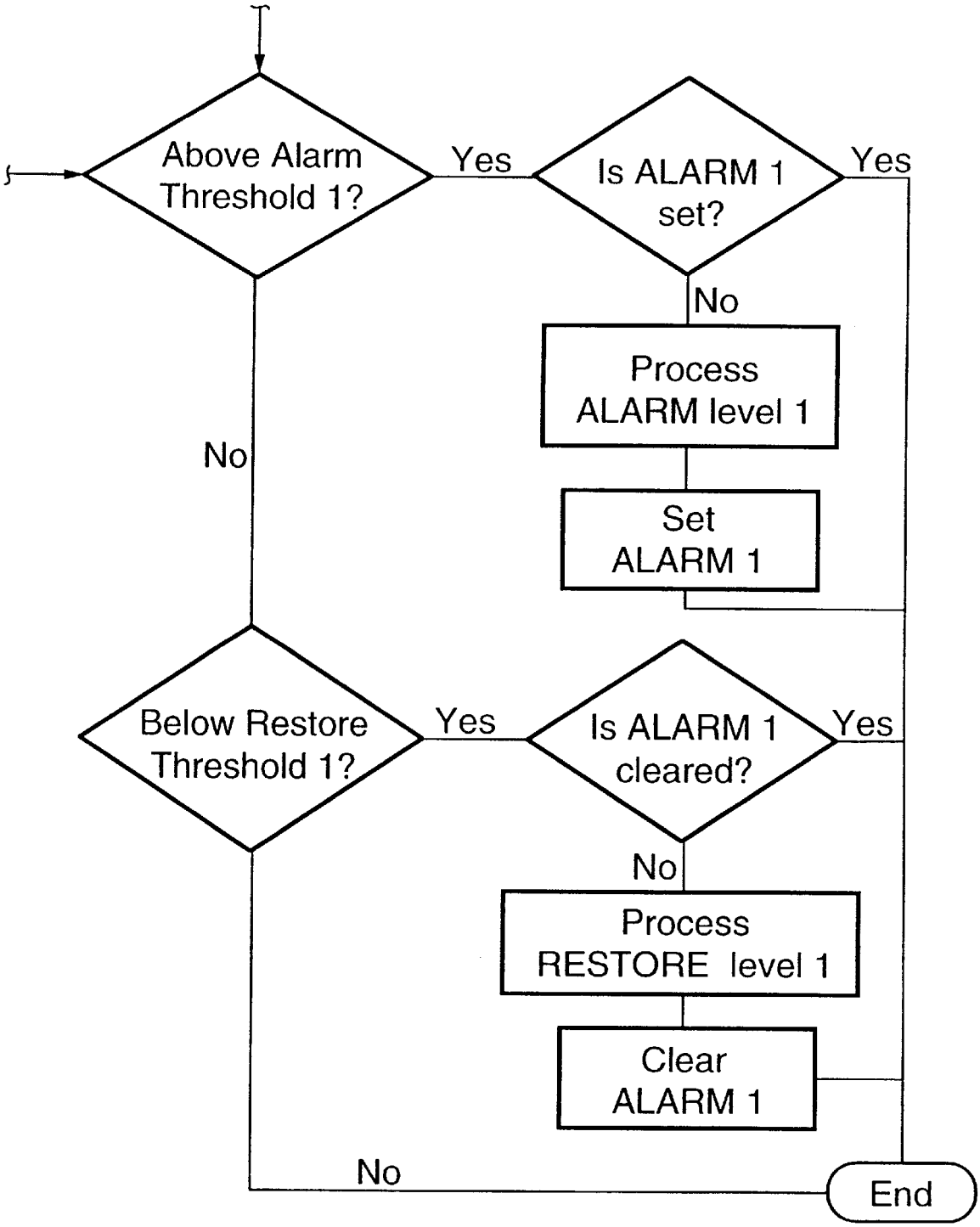

FIG. 3 illustrates a flow diagram for one embodiment of a program for use in a system having multiple set points such as that illustrated in FIGS. 1 and 2 for evaluating the temperature in a monitored area. In the system, the temperature sensor 32 will be periodically queried by the processing means 28 for the current temperature. Each time a new temperature is acquired, this routine will be processed. In the flowchart of FIG. 3, ALARM 1, ALARM 2, and ALARM 3 represent flags (single bit volatile storage locations which are preferably provided as part of the processing means 28). These flags are used to track the current state of each of the alarm levels. If the flag is set, the associated alarm is active, if the flag is clear or not set, the associated alarm is not active.

Once acquired, the temperature is compared against ALARM 3 and RESTORE 3 thresholds to determine whether it falls above, below, or within this range. If the acquired temperature is above the ALARM 3 threshold and ALARM 3 is not currently active, the action assigned to the ALARM 3 event is activated and the ALARM 3 flag is set. If the acquired temperature is below the RESTORE 3 threshold and ALARM 3 is currently active, the action assigned to the RESTORE 3 event is processed and the ALARM 3 flag is cleared. Once the appropriate action has been taken or if any of the above conditions are not met, the same tests are performed for the ALARM 2 and ALARM 1 ranges. Once all tests and actions are complete, program control of the processing means 28 is returned to the main routine.

A preferred embodiment of the present invention has been described above with respect to an alarm system for use in a cold storage area, where the keypad, which is located within the area to be monitored is provided with a programmable temperature sensor for monitoring the temperature in the area. The temperature sensor interfaces with the processing means of the keypad controller and the alarm control panel to provide the processing means and control panel with an indication of the temperature in the space being monitored at any given time. The processing means and control panel compare the temperature indication of the temperature sensor to one or more thresholds programmed in either the keypad controller or the control panel and the system takes various actions such as described above, based upon the results of the comparison.

The temperature thresholds of the alarm system are fully programmable and can be easily adjusted based upon the requirements of the system and the location being monitored.

In addition to the keypad controller, other devices used in alarm and security systems may also be provided with programmable temperature sensors. For example, a smoke detector could be provided with the temperature sensor to provide for further functionality of the smoke detector. The temperature sensor could have programmed thresholds to allow it to function as a heat or rate of rise detector. The temperature sensor could also be programmed such that one of the actions taken could be to adjust the sensitivity of the detector for detecting fire conditions. If the temperature sensor finds that the temperature in the space being monitored is rising but at a rate less than the rate set for the rate of rise function, one of the actions taken could be to provide a local or remote trouble condition. Another potential action could be to adjust the sensitivity of the rate of rise or heat detector to provide an earlier warning of a potential fire condition.

The programmable temperature sensor of the present invention may also be provided with a means for determining time of day as well as day of year. By providing an indication to the temperature sensor as to the time of day as well as day of year, additional functionality may be provided to the alarm system. For example, where the alarm system is located in a space which is usually only occupied during weekdays, the system could be programmed for different functions depending upon the day and time of day. During the time the space is occupied, the system may be programmed to monitor mainly for temperature rises above set points and would provide a local trouble indication at the first threshold. At night when it is expected that the temperature in the space will naturally decrease, the primary monitoring may utilize a lower ALARM threshold than during the day. In addition, as it would be expected that no one would be occupying the space, on exceeding the first threshold, the system may, in addition to providing a local trouble indication, be programmed to provide a trouble condition indication to a remote monitoring station so that action may be taken at the first instance.

By providing the system with day of year indication, the system may also be programmed to take different actions on days when it is expected that the space would not be occupied such as on weekends and holidays. The system could also be programmed to take into account the changes in seasons based upon the day of year indication. For example, it is extremely unlikely that an occupied space would be at risk of reaching freezing temperatures during the summer months, so the primary thresholds for the system in the summer would be to monitor for temperature rises. Conversely, in winter, when the risk of freezing is greater, the primary monitoring would be for temperature decreases.

While the system has been described as having a primary monitoring threshold which can change based upon time of day and day of year, the system may be programmed to continue to monitor for changes in temperature in both directions. The time of day or day of year may be used as a parameter to vary the action taken in response to the system detecting that any particular ALARM threshold has been exceeded.

The programmable temperature sensor of the present invention may also be adapted to respond to the state of the alarm system. In many situations, the alarm system may function as a security system which will be armed when the premises are not occupied. When the alarm system is armed, the action taken upon detecting that a temperature ALARM threshold has been exceeded may differ from that taken when the system is not armed. When the system is armed, it would be expected that no one would be occupying the premises and the response to a first ALARM threshold being exceeded could include notification of a remote monitoring service or other remote location such as a business owner. When the system is disarmed, it would be expected that someone will be occupying the space and a local notification would be given to the first ALARM threshold being exceeded.

The preferred embodiment of the system described above having a keypad with the temperature sensor of the present invention is adaptable to many different applications. The embodiment illustrated is for use in a location where temperature rise is being monitored. The system is equally adaptable for monitoring temperature decrease such as in a space which is required to be heated or for situations where both temperature decrease and increase are being monitored such as in a space where the temperature must be maintained within a specified range. If it is desirable to monitor temperature decrease, either on its own or in conjunction with temperature increase, the ALARM thresholds would be set based upon the desired temperature at which the various alarm events should occur. The individual RESTORE thresholds would be set a few degrees higher than their respective ALARM thresholds to provide for hystersis. The operation of the system would be similar to the embodiment described, with the monitored temperature being examined against the extreme ALARM and RESTORE thresholds first, followed by the less extreme ALARM and RESTORE thresholds. The system could be programmed to test against the extreme high or low threshold followed by the other extreme high or low threshold. The system would then test against each pair of less extreme thresholds, testing against one of the high or low thresholds followed by the other. This would continue until either the monitored temperature has been tested against all of the thresholds at which time control would be returned to the main routine or an alarm condition is detected, at which time the action associated with the alarm condition is taken.

The preferred embodiment illustrated has the control programs for the temperature threshold testing resident in the keypad controller. In this embodiment, the processing means has the necessary programming to test the monitored condition against the thresholds as described above. If an alarm event is determined from this testing, the processing means of the keypad controller passes an instruction to the alarm control panel to initiate the appropriate alarm notification. If no alarm event is detected by the processing means, the control returns to the main routine for the processing means as described above.

In some situations, some or all of this control program could be resident in the alarm control unit. The keypad could monitor the temperature and test against the thresholds and pass the results of the tests on to the control panel, where the results would be processed to take the appropriate action. Alternatively, the processing means of the keypad controller could monitor the temperature of the temperature sensor and pass the level of the monitored temperature on to the control panel where all of the processing and testing of the temperature against the thresholds would be carried out.

The device for an alarm system of the present invention including the programmable temperature sensor allows for cost effective alarm and security systems to be designed with flexibility in monitoring temperature in a space and taking appropriate action depending upon the temperature in the space. The set point of the programmable temperature sensor is easily adjusted based upon the application and the desired alarm point by changing the value of the set point stored in the memory to which the temperature of the space is compared. In addition, the action to be taken by the alarm system in response to the temperature exceeding the set point value is easily programmable by changing the routine stored in the memory.

The programmable temperature sensor of the preferred embodiment of the present invention with multiple programmable set points allows for alarm and security systems having increased flexibility in monitoring the temperature and taking appropriate action. By the provision of the multiple set points, problems in temperature control can be detected earlier than systems which use a single set point and different actions can be assigned to each threshold level. The individual set points are programmable, allowing the system to be easily adapted to many different locations and applications. By providing multiple set points, both over and under temperature can also be monitored.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A detection device for use in an alarm system, the device comprising the combination of an alarm system sensor selected from the group consisting of motion detectors, glass break detectors, shock sensors, fire or smoke detectors, and water detectors, and a programmable temperature sensor for monitoring the temperature in the space in which the device is to be located, the temperature sensor being provided with a plurality of individual alarm set points, each set point being independently programmable as to level and effect.

2. A device for use in an alarm system according to claim 1 wherein the temperature sensor comprises a temperature sensing means for sensing the temperature in the space, a processing means for comparing the temperature against the alarm set points and an interface or signal conditioning means for providing an indication of the temperature to the processing means.

3. A keypad controller for use in an alarm system, the keypad controller comprising, an enclosure having an input means for allowing a user to interface with the keypad controller and an alarm system to which the keypad controller is connected, and an output means for providing one or more of visual and auditory feedback to a user on the status of the system, the enclosure containing an interface means for communicating with an alarm control panel of the alarm system, a processing means for processing inputs from the input means or the alarm control panel and causing the appropriate information to be provided to the output means, and a programmable temperature sensor for monitoring the temperature in the space in which the keypad controller is to be located, the temperature sensor having at least one alarm set point programmable as to level.

4. A keypad controller as claimed in claim 3 wherein the temperature sensor includes a temperature sensing means for sensing the temperature in the space, and an interface or signal conditioning means for providing an indication of the temperature to the processing means.

5. A keypad controller as claimed in claim 3 wherein the alarm set point is also programmable as to effect.

6. A keypad controller as claimed in claim 3 wherein the temperature sensor is provided with a plurality of alarm set points, each set point being independently programmable as to level and effect.

* * * * *